US006666699B2

(12) United States Patent
Uratani

(10) Patent No.: US 6,666,699 B2
(45) Date of Patent: Dec. 23, 2003

(54) COAXIAL CONNECTOR AND COMMUNICATION DEVICE HAVING THE SAME

(75) Inventor: Chikara Uratani, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/910,977

(22) Filed: Jul. 23, 2001

(65) Prior Publication Data

US 2002/0009912 A1 Jan. 24, 2002

(30) Foreign Application Priority Data

Jul. 21, 2000 (JP) ..... 2000-221399

(51) Int. Cl.[7] ..... H01R 29/00
(52) U.S. Cl. ..... 439/188; 439/944; 439/578
(58) Field of Search ..... 439/188, 63, 944, 439/578, 877, 909, 581, 618

(56) References Cited

U.S. PATENT DOCUMENTS 4,561,716 A * 12/1985 Acke ..... 339/177
5,074,809 A * 12/1991 Rousseau ..... 439/675
5,466,160 A * 11/1995 Ogura ..... 439/63
5,563,562 A * 10/1996 Szwec ..... 333/260
5,989,046 A * 11/1999 Togashi ..... 439/188
6,074,217 A * 6/2000 Maruyama et al. ..... 439/63
6,099,334 A * 8/2000 Togashi ..... 439/188
6,217,382 B1 * 4/2001 Ziers ..... 439/578

FOREIGN PATENT DOCUMENTS

| | | | | |
|---|---|---|---|---|
| EP | 0 782 219 | | 7/1997 | |
| EP | 0 929 128 | | 7/1999 | |
| EP | 1 115 183 | | 7/2001 | |
| GB | 2 307 113 A | * | 5/1997 | ..... 17/4 |
| JP | 9-213421 | | 8/1997 | |
| JP | 9-245907 | | 9/1997 | |
| JP | 11-307188 | * | 5/1999 | ..... 17/4 |
| JP | 2001-015226 A | | 1/2001 | |
| JP | 2001-176612 A | | 6/2001 | |
| JP | 2001-196136 A | | 7/2001 | |

* cited by examiner

*Primary Examiner*—P. Austin Bradley
*Assistant Examiner*—Edwin A. León
(74) *Attorney, Agent, or Firm*—Keating & Bennett, LLP

(57) ABSTRACT

A coaxial connector includes a synthetic resin insulating case having a lower insulating case and an upper insulating case, a metallic fixed terminal, a movable terminal, and an external terminal. The terminals are fixed to the upper insulating case by heat welding. Thereafter, the solid portions of the terminals are sandwiched between the insulating cases and the lower and upper insulating cases are assembled in only one direction.

18 Claims, 10 Drawing Sheets

COAXIAL CONNECTOR AND COMMUNICATION DEVICE HAVING THE SAME

BACKGROUND OF THE INVENTION

1. Field of the Invention

The present invention relates to a coaxial connector and a communication device including a coaxial connector.

2. Description of the Related Art

Some mobile communication devices such as portable telephones, include a surface mount type coaxial connector that performs a switching function of changing a signal path is used. In conventional coaxial connectors, for the purpose of reducing the number of manufacturing steps, a resin insulating case, a fixed terminal, and a movable elastic terminal having a spring property are integrally formed by insert molding, whereby the number of elements of the device is reduced.

However, when the device elements are integrally formed, the unit costs thereof are high. The main reason is that the maintenance cost of the production facilities and tools such as metal molds is increased in order to maintain a high quality of the device elements that are integrally formed, inspection of the quality of the device elements must be carefully performed, the acceptance ratio of the integrally formed device elements is reduced, and so forth. Moreover, for integral molding, highly complicated techniques are needed. Especially, in the case of small-sized, low-height coaxial connectors for which it is required to have a dimensional tolerance of several tens of $\mu$m, generation of resin burs at insert molding is a critical problem to be solved.

SUMMARY OF THE INVENTION

In order to overcome the problems described above, preferred embodiments of the present invention provide a high quality, low cost coaxial connector in which the number of manufacturing steps is greatly reduced, and a communication device having such a high quality, low cost coaxial connector.

According to a preferred embodiment of the present invention, a coaxial connector includes a first resin member having a concave portion into which a center contact of a mating coaxial connector is inserted, a second resin member for constituting an insulating case with the first resin member, a fixed terminal and a movable terminal fixed to one of the first resin member and the second resin member, and an external terminal mounted on the outside of the insulating case and electrically connected to an outer conductor of the mating coaxial connector, in which the fixed terminal and the movable terminal are sandwiched between the first resin member and the second resin member.

In the above-described configuration, the fixed terminal and the movable terminal are preferably separate components from the insulating cases, respectively. Thus, assembly of the various parts of the device can be carried out with less difficulty as compared with that of conventional assembly wherein the device elements are integrally formed by insert molding. Accordingly, the sum of the unit costs of the respective device elements is greatly reduced as compared with that of the conventional assembly parts.

Preferably, the coaxial connector has a structure in which the first resin member, the second resin member, the fixed terminal, the movable terminal, and the external terminal are overlaid on each other, and assembling of the first resin member, the second resin member, the fixed terminal, the movable terminal, and the external terminal is carried out in one direction.

Preferably, during assembly of the coaxial connector having the above-described unique configuration, the device elements such as the terminals, the resin members, and so forth are overlaid on each other sequentially to be incorporated while the work pieces are sequentially conveyed. Accordingly, even if the number of device elements is increased, the number of production processes is prevented from being increased. Moreover, since the assembly and incorporation work of the device elements is carried out in one direction, the production efficiency is even more enhanced.

A communication device according to another preferred embodiment of the present invention includes the coaxial connector having the above-described structure. Thus, reduction of the cost and enhancement of the device qualities are achieved.

Other features, elements, characteristics, and advantages of the present invention will become more apparent from the following detailed description of the preferred embodiments of the present invention with reference to the attached drawings.

DETAILED DESCRIPTION OF PREFERRED EMBODIMENTS

Hereinafter, preferred embodiments of a coaxial connector and a communication device having the coaxial connector in accordance with the present invention will be described with reference to the accompanying drawings.

Figure 1:
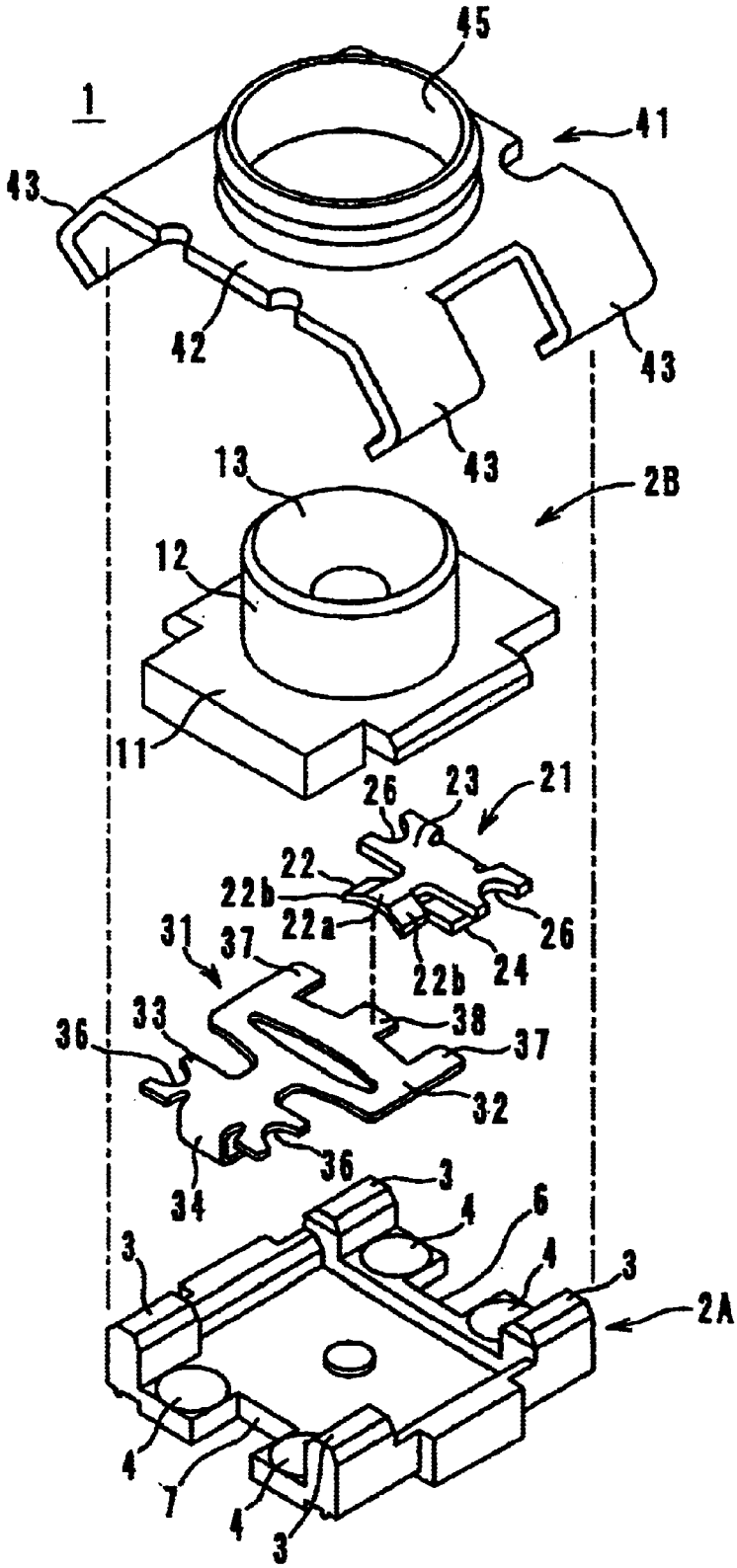
FIG. 1 is an exploded perspective view of a coaxial connector according to a preferred embodiment of the present invention.

FIG. 1 is an exploded perspective view showing the constitution of a coaxial connector according to a preferred embodiment of the present invention. Hereinafter, the details of the coaxial connector (coaxial receptacle) 1 of preferred embodiments of the present invention, together with the assembling procedures, will be described. The coaxial connector 1 preferably includes an insulating case preferably made of synthetic resin which includes a lower insulating case 2A and an upper insulating case 2B, a fixed terminal 21, a movable terminal 31, and an outer terminal (outer conductor) 41 which are preferably made of metal.

The lower insulating case 2A preferably has a substantially rectangular shape. Guiding protuberances 3 for positioning the upper insulating case 2B are provided preferably in the four corners on the upper surface (dividing plane) of the case 2A, and rib receiving portions 4 for receiving the ribs 18 (see FIG. 2) of the upper insulating case 2B are formed in the vicinity of the guiding protuberances 3. The rib receiving portions 4 each have a concave plane shape, i.e., a reverse dome-shape (see FIG. 10). Moreover, substantially rectangular cuts 6 and 7 are formed in the centers of the two opposed sides of the lower insulating case 2A, respectively. In the cut 6, the lead 24 of the fixed terminal 21 is received. On the other hand, the lead 34 of the movable terminal 31 is received in the cut 7.

The upper insulating case 2B contains a substantially rectangular cover 11 and a columnar introduction portion 12 in the center of the upper surface of the cover 11. The columnar introduction portion 12 is opened in a cone-shape in the upper portion thereof, and has an introduction hole 13 having a substantially circular cross-section. The introduction hole 13 elongates through the upper insulating case 2B. The center contact of a mating coaxial connector protrudes into the introduction hole 13 from the cone-shaped opening side.

Figure 2:
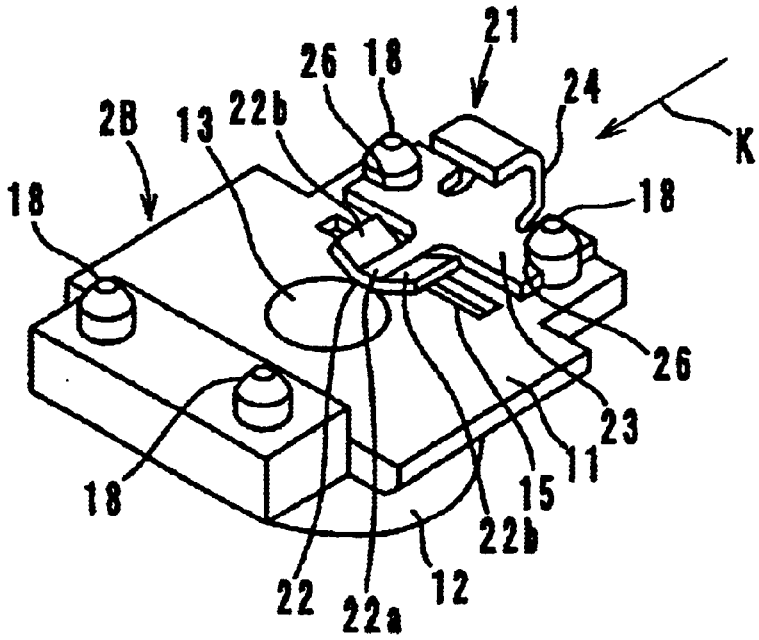
FIG. 2 is a perspective view illustrating an assembling process of the coaxial connector shown in FIG. 1.

Moreover, the columnar ribs 18 are provided in the four corners on the bottom (dividing plane) of the upper insulating case 2B as shown in FIG. 2. There ribs 18 are provided in order to position the fixed metallic terminal 21 and the movable terminal 31. The tops of the ribs 18 have a C-shaped plane, so that the terminals 21 and 31 can be easily guided. A groove 15 having a substantially V-shaped cross section is formed between the introduction hole 13 and the side of the fixed terminal 21 from which the fixed terminal 21 extends. The groove 15 is elongated in a direction that is substantially perpendicular to the leading-out direction of the metallic fixed terminal 21. The groove 15 prevents a flux contained in soldering paste from permeating into the insulating case.

The fixed terminal 21 is preferably formed by punching and bending a metallic flat sheet. The fixed terminal 21 includes a contact portion 22 that is in contact with the movable terminal 31, a fixed portion 23 fixedly sandwiched between the insulating cases 2A and 2B, and a lead 24 that has a substantially L-shaped configuration. The contact portion 22 is preferably formed by bending both side portions thereof at a predetermined angle, and contains a horizontal plane 22*a* and inclined planes 22*b* on both of the sides of the horizontal plane 22*a*.

The fixed portion 23 is provided with half-circular concavities 26 on both of the sides thereof. The concavities 26 are fitted onto the ribs 18 of the upper insulating case 2B, respectively, so that the fixed terminal 21 is incorporated in the upper insulating case 2B with a high positional accuracy. Then, the upper insulating case 2B is set in an assembly apparatus with the bottom surface thereof facing upward. In this case, the fixed terminal 21 is incorporated from the upper portion of the upper insulating case 2B so that the horizontal surface 22*a* and the fixed portion 23 of the contact portion 22 come into close contact with the bottom of the upper insulating case 2B. A gap is formed between the fixed terminal 21 and the groove 15 which intersect each other.

Figure 3:
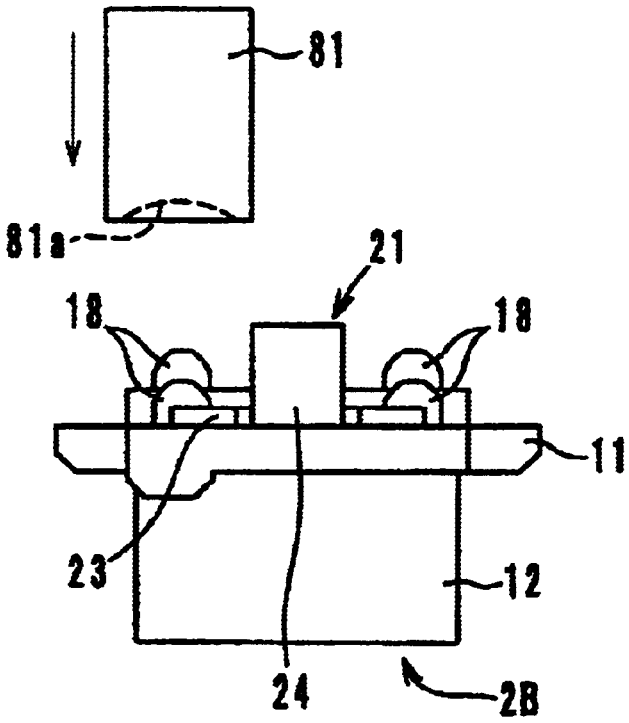
FIG. 3 is a side view illustrating manufacturing steps performed after the steps shown in FIG. 2.
Figure 4:
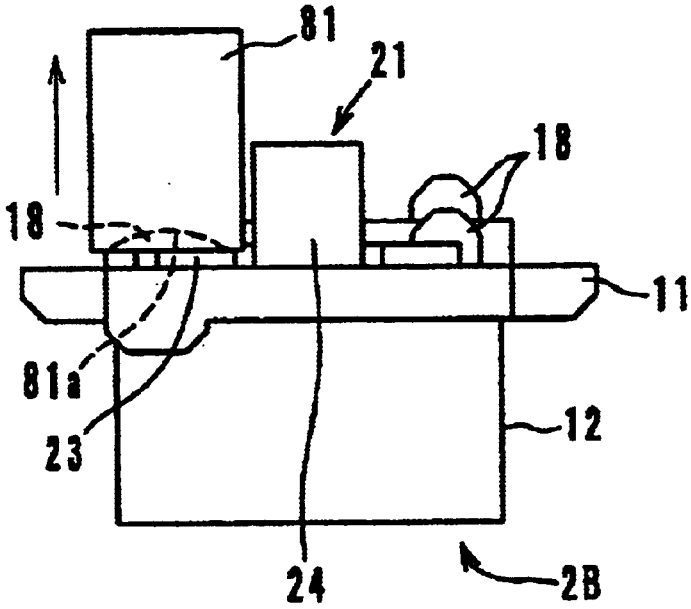
FIG. 4 is a side view illustrating manufacturing steps performed after the steps shown in FIG. 3.
Figure 5:
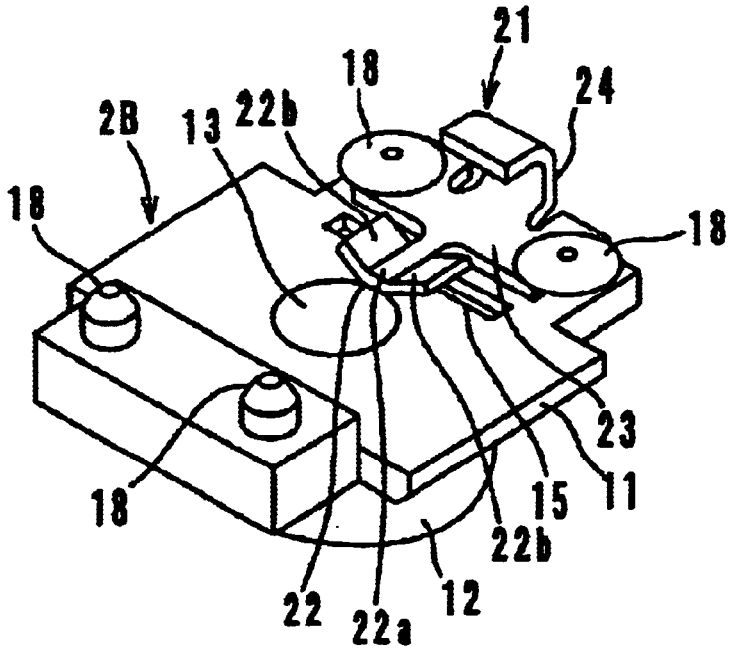
FIG. 5 is a perspective view illustrating manufacturing steps performed after the steps shown in FIG. 4.

Then, as shown in FIG. 3, the head chip 81 of a welding device is lowered from the upper of each of the ribs 18 positioning the fixed terminal 21 to be pushed against the rib 18. FIG. 3 is a side view of the coaxial connector taken in the direction indicated by arrow K in FIG. 2. The top surface 81*a* of the head chip 81 has a concave shape, such as a reversed dome shape. In this case, the head chip 81 is heated at a temperature at which the rib 18 can be sufficiently deformed thermally. Accordingly, as shown in FIG. 4, the rib 18 is thermally deformed by the top 81*a* of the head chip 81 into a dome shape. Thereafter, the head chip 81 is elevated. Similarly, the other rib 18 for positioning the fixed terminal 21 is thermally deformed into a dome shape. Thus, as shown in FIG. 5, the fixed terminal 21 is heat welding-fixed to the bottom of the upper insulating case 2B via thermally deformed dome-shaped ribs 18.

The movable terminal 31 (see FIG. 1) is preferably formed by punching a metallic sheet having a spring property into a predetermined shape and size, and bending it. The movable terminal 31 is constructed to have a spring-movable function, and includes a movable contact portion 32 that contacts with the fixed terminal 21, a fixed portion 33 fixedly sandwiched between the insulating cases 2A and 2B, and a lead 34 having a substantially L-shaped configuration. The movable contact portion 32 is bent so as to rise upward into an arc shape. Spring supports 37 are provided on both of the ends of the movable contact portion 32, and a spring contact portion 38 is provided in the center thereof.

Figure 6:
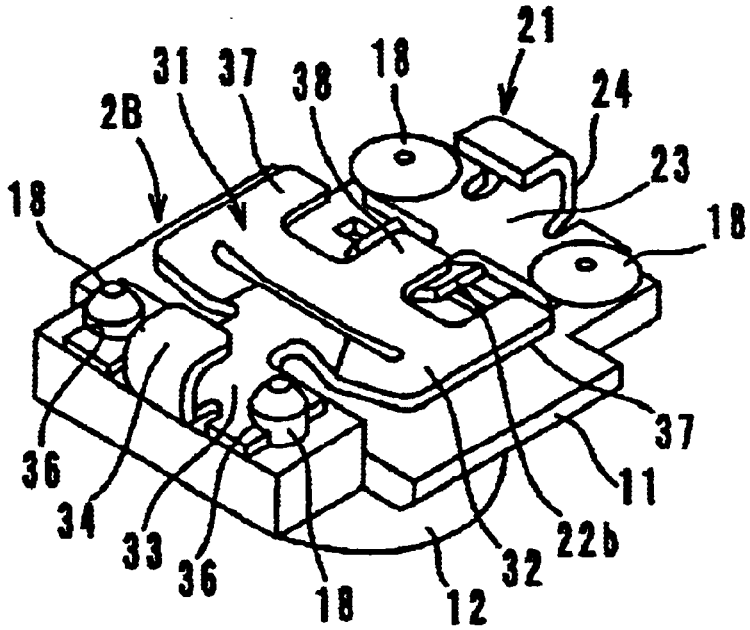
FIG. 6 is a perspective view illustrating manufacturing steps performed after the steps shown in FIG. 5.

Half-circular concavities 36 are formed on both of the sides of the fixed portion 33. The concavities 36 are fixed onto the ribs 18 of the upper insulating case 2B, respectively, as shown in FIG. 6, so that the movable terminal 31 is incorporated into the upper insulating case 2B with a high positional accuracy. Then, the movable terminal 31 is incorporated from the upper portion of the upper insulating case 2B in an assembly apparatus with the bottom portion of the case 2B facing upward, so that the fixed portion 33 comes in close contact with the bottom of the upper insulating case 2B.

Figure 7:
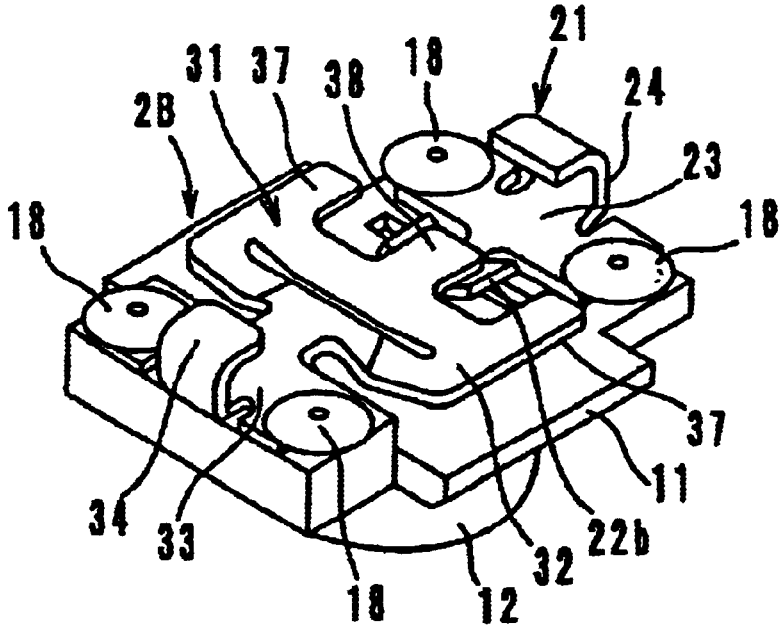
FIG. 7 is a perspective view illustrating manufacturing steps performed after the steps shown in FIG. 6.

Next, head chips 81 of the welder are pushed against the two ribs 18 positioning the movable terminal 31, from the upper portion of the upper insulating case 2B, using the same procedures as described in reference to FIGS. 3 and 4, so that the ribs 18 are thermally deformed into a dome shape. Thus, as shown in FIG. 7, the movable terminal 31 is heat welding-fixed to the bottom of the upper insulating case 2B via the ribs 18 which have been thermally deformed into a dome shape. Thus, the terminals 21 and 31 are fixed to the upper insulating case 2B.

On the other hand, the outer terminal 41 (see FIG. 1) disposed to be in contact with the outer conductor of a mating coaxial connector is preferably formed by punching a metal sheet, e.g., made of brass, spring-use phosphor bronze, or other suitable material, bending, drawing, or other suitable process. A flat portion 42 in the center of the sheet body is arranged to cover the upper surface of the upper insulating case 2B. Legs 43 are provided preferably in the four corners of the flat portion 42, respectively. Moreover, in the center of the flat portion 42, a substantially cylindrical through-hole portion 45 is arranged so as to be concentric with the columnar introduction portion 12 of the upper insulating case 2B. The substantially cylindrical through-hole portion 45 is fitted onto the outer conductor of the mating coaxial connector. Ordinarily, the outer terminal 41 functions as a ground. The outer surface of the outer terminal 41 is plated, if necessary.

Figure 8:
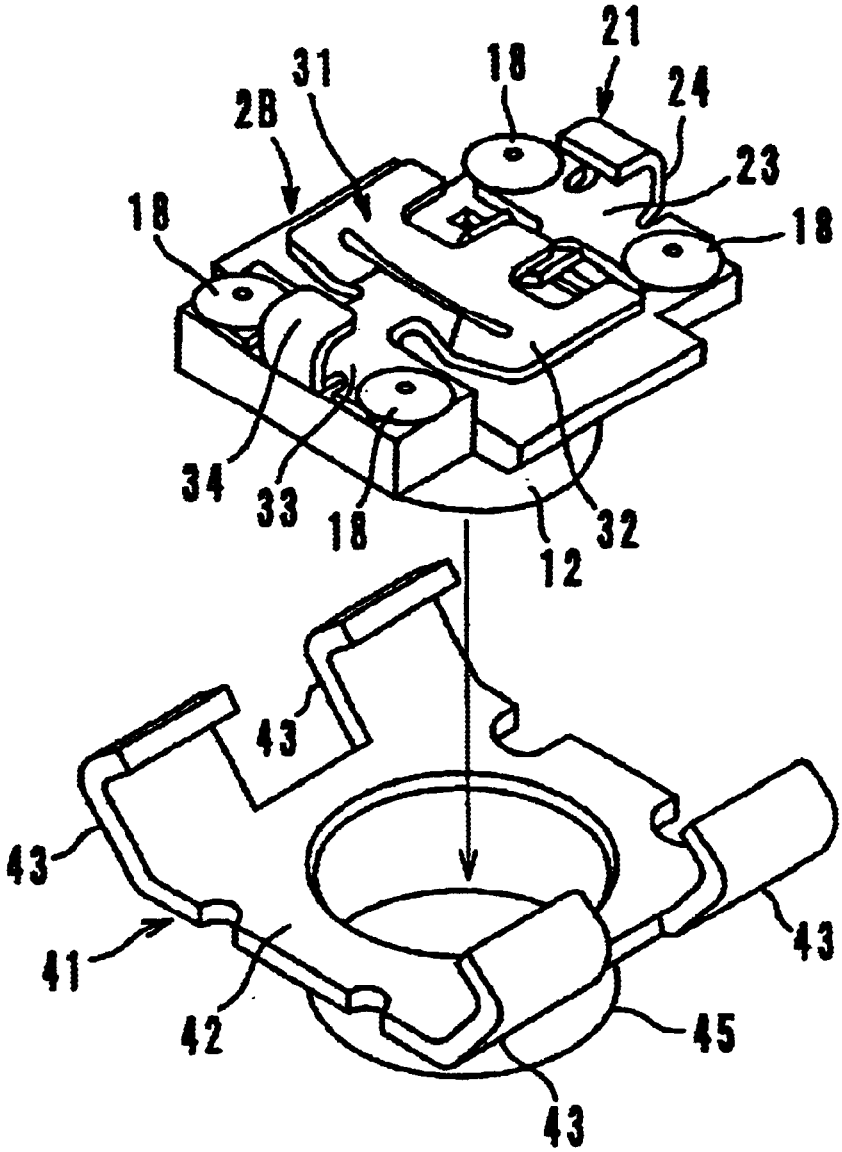
FIG. 8 is a perspective view illustrating manufacturing steps performed after the steps shown in FIG. 7.
Figure 9:
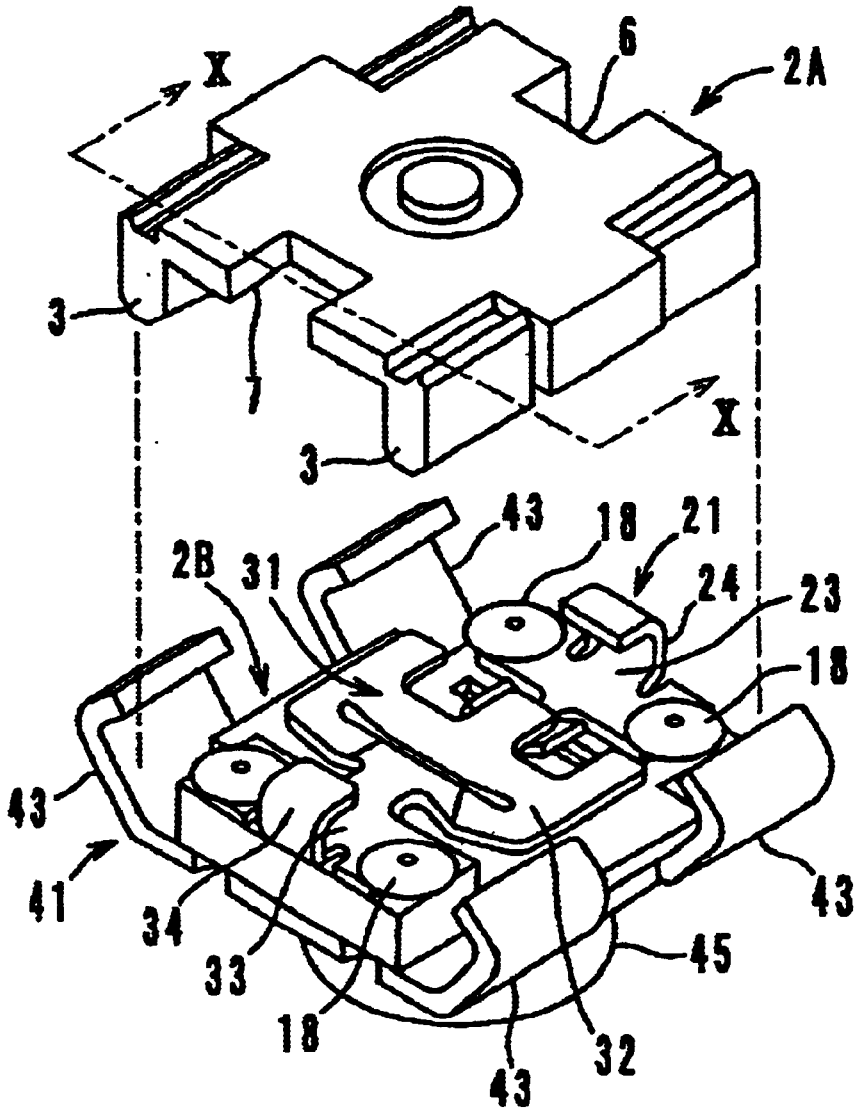
FIG. 9 is a perspective view illustrating manufacturing steps performed after the steps shown in FIG. 8.

As shown in FIG. 8, the outer terminal 41 is set on an assembly apparatus with the bottom portion thereof facing upward. Then, the upper insulating case 2B having the terminals 21 and 31 fixed thereto is conveyed to the upper portion of the outer terminal 41 with the bottom portion thereof facing upward. Moreover, from the upper direction of the external terminal 41, the upper insulating case 2B is overlaid and incorporated into the external terminal 41. That is, the columnar introduction portion 12 of the upper insulating case 2B is fitted into the substantially cylindrical through-hole portion 45 of the outer terminal 41. Thereafter, as shown in FIG. 9, the lower insulating case 2A is overlaid on the upper insulating case 2B.

Figure 10:
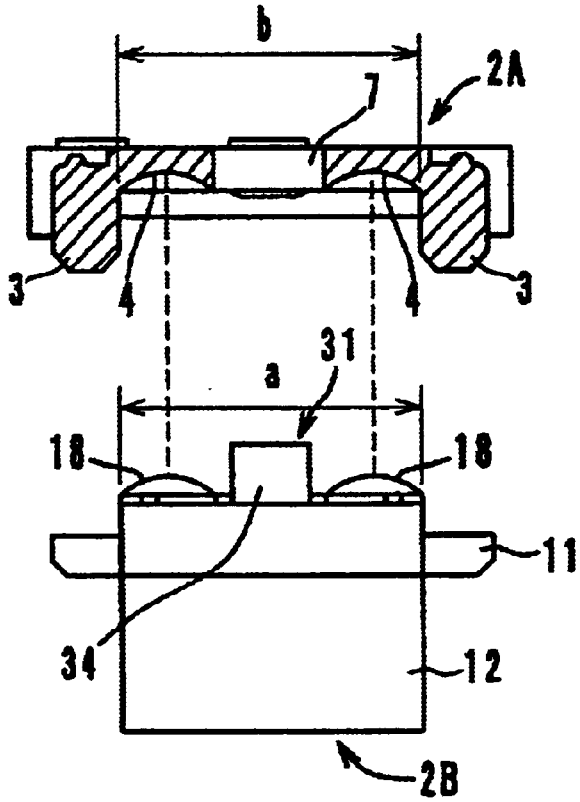
FIG. 10 is a partial cross sectional view illustrating self-alignment effects between the insulating cases.

In FIG. 10, ordinarily, the size a of the upper insulating case 2B is preferably smaller than the size b of the lower insulating case 2A. The reason is that the working efficiency with which the lower insulating case 2A is incorporated into the upper insulating case 2B is greatly improved. FIG. 10 is a partial cross sectional view of the coaxial connector taken in the direction X—X in FIG. 9.

Figure 11:
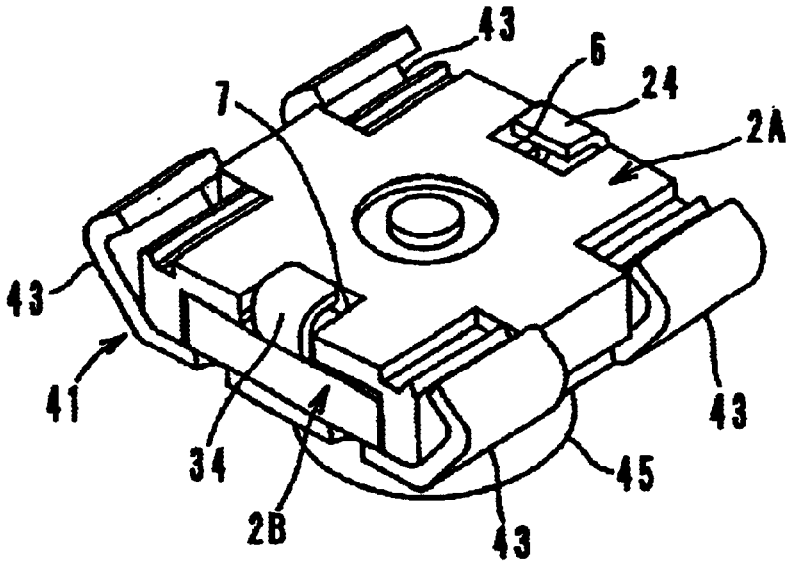
FIG. 11 is a perspective view illustrating manufacturing steps performed after the steps shown in FIG. 9.

However, if the sizes a and b have the relationship of $a<b$, the incorporated lower insulating case 2A becomes shaky, that is, the set position is unstable. Accordingly, in the first preferred embodiment of the present invention, the ribs 18 of the upper insulating case 2B are preferably thermally deformed to have a domed shape, and also, the rib relief portions 4 of the lower insulating case 2A are formed so as to have a reversed dome shape. That is, when the ribs 18 are combined with the rib receiving portions 4, a self-alignment effect is achieved, so that the lower insulating case 2A can be incorporated into the upper insulating case 2B with high accuracy, and moreover, the shaky setting position can be prevented (see FIG. 11).

Figure 12:
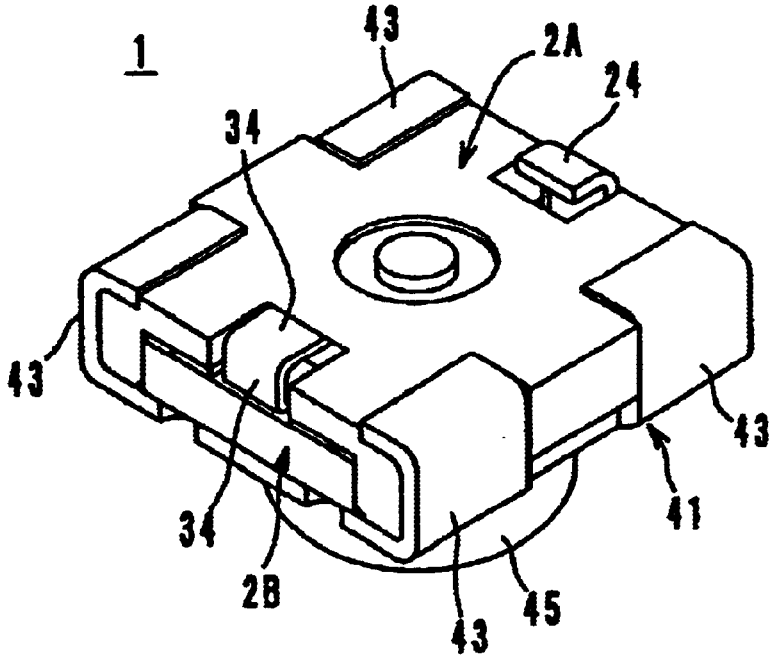
FIG. 12 is a perspective view illustrating manufacturing steps performed after the steps shown in FIG. 11.

Next, the legs 43 of the outer terminal 41 are caulked from the upper direction to obtain an assembly having the structure in which the terminals 21 and 31 and the insulating case 2A and 2B are overlaid on each other as shown in FIG. 12. Thereby, the structure of the assembly becomes rigid, firm and stable.

Figure 13:
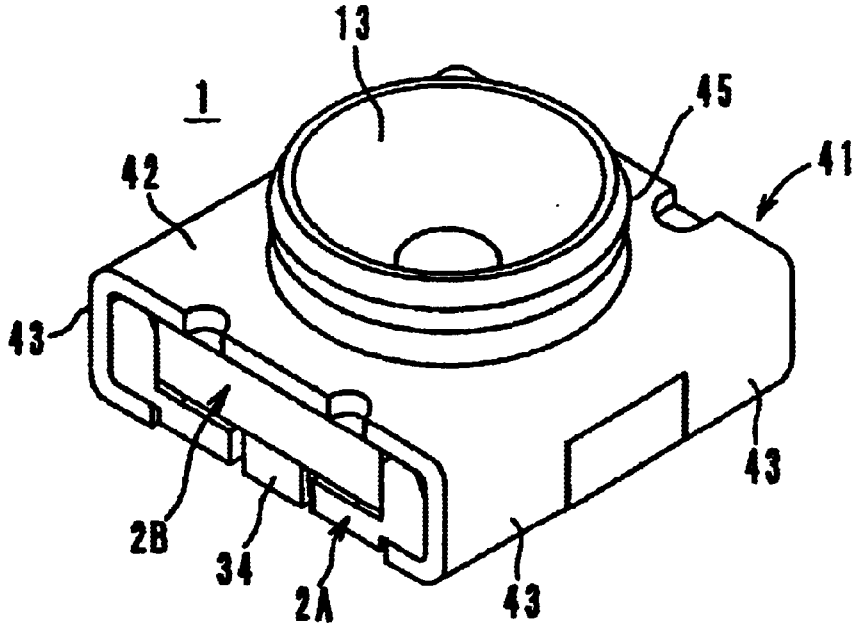
FIG. 13 is a perspective view showing the appearance of the coaxial connector of FIG. 1.

FIG. 13 is a perspective view of the coaxial connector 1 having a switching function, assembled as described above and viewed from the upper surface thereof. In the coaxial connector 1, the top portions of the leads 24 and 34 of the terminals 21, 31, and 41, and the legs 43 are arranged so as to be substantially on the same plane as the bottom of the lower insulating case 2A. Thus, the coaxial connector 1 has a structure such that surface-mounting of components on the coaxial connector can be carried out. Moreover, in the outer terminal 41, the substantially cylindrical through-hole portion 45 is arranged such that secure and stable connection to the mating coaxial connector is achieved.

Figure 14:
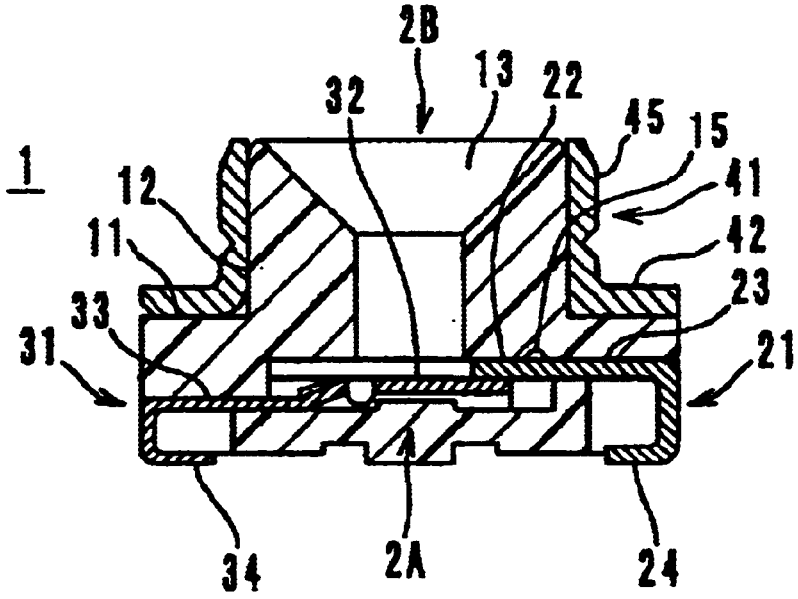
FIG. 14 is a cross sectional view of the coaxial connector shown in FIG. 12.

As shown in FIG. 14, in the inner space of the insulating case defined by the combination of the insulating cases 2A and 2B, the fixed terminal 21 and the movable terminal 31 are arranged so that the fixed terminal 21 lies on the movable terminal 31. Regarding the fixed terminal 21 and the movable terminal 31, the fixed portions 23 and 33 are sandwiched between the insulating cases 2A and 2B, respectively. Thereby, the positions of the terminals 21 and 31 are determined with respect to the insulating cases 2A and 2B. Thus, the terminals 21 and 31 can be easily fixed with respect to the insulating cases 2A and 2B. Moreover, since the fixed terminal 21 and the movable terminal 31 are formed separately from the insulating cases 2A and 2B, respectively, the assembly and processing of the device elements can be achieved with less difficulty as compared with conventional device elements that are integrally formed by insert molding. Thus, the sum of the unit costs of the device elements 2A, 2B, 21, 31, and 41 is much lower than that of the conventional device elements.

In production of the coaxial connector 1, the respective assembled device elements 2A, 2B, 21, 31 and 41 are overlaid on each other and incorporated sequentially while the work pieces are being sequentially fed. Accordingly, the finishing states of the work pieces in the respective processes can be easily and accurately checked, respectively. Thus, rejected products can be detected much earlier in the respective processes, and the quality of the products is greatly improved. In addition, useless assembly of the rejected products is eliminated, so that the product cost can be reduced. Moreover, since the incorporation of the device elements 2A, 2B, 21, 31, and 41 is carried out in one direction (from the upper direction), the production efficiency is even more improved.

Furthermore, the dome-shaped ribs 18 fix the terminals 21 and 31 and the upper insulating case 2B before hand. Accordingly, in the case in which the terminals 21 and 31 are sandwiched between the lower insulating case 2A and the upper insulating case 2B, there is no danger that the terminals 21 and 31 are released or shifted from position, which may be caused by vibration or impact while the parts are conveyed in the production facilities.

Moreover, the sizes of the contact portion 22 of the fixed terminal 21 and the movable contact portion 32 of the movable terminal 31 are relatively small. Therefore, it is a large factor in enhancement of the mechanical performance (the spring performance of the movable contact portion 32) of the coaxial connector 1 that the contact positions of the contact portion 22 and the movable contact portion 32 are accurately determined. In the coaxial connector 1, after the terminals 21 and 31 are heat-welded to the upper insulating case 2B, the contact position between the contact portion 22 and the movable contact portion 32 can be checked. Therefore, a deficiency in contact between the contact portion 22 and the movable contact portion 32 can be detected during assembly. Thereby, checking on the contact state between the contact portion 22 and the movable contact portion 32, carried out after completion of the assembly, is greatly simplified. Thus, the number of processes can be reduced. As a result, the coaxial connector 1 which has very high quality and is inexpensive is provided.

Furthermore, in the first preferred embodiment, the respective device elements to be assembled 2A, 2B, 21, 31, and 41 are fixed preferably by heat welding and caulking, not using a chemical material such as an adhesive, a solder, or the like. Accordingly, in the case in which the production line facilities are stopped for a moment for maintenance or some other reason, it is not necessary to consider degradation of the chemical material. Accordingly, the production line facilities can be quickly re-started.

Hereinafter, operation of the coaxial connector 1 will be described with reference to FIGS. 14 and 15.

As shown in FIG. 14, when no mating coaxial connector is mounted, the movable contact portion 32 is in the state such that the center portion thereof rises upwardly, and thereby, the movable terminal contacts with the fixed terminal 21, because of the spring property of the movable contact portion 32. Thus, both of the terminals 21 and 31 are electrically connected to each other.

Figure 15:
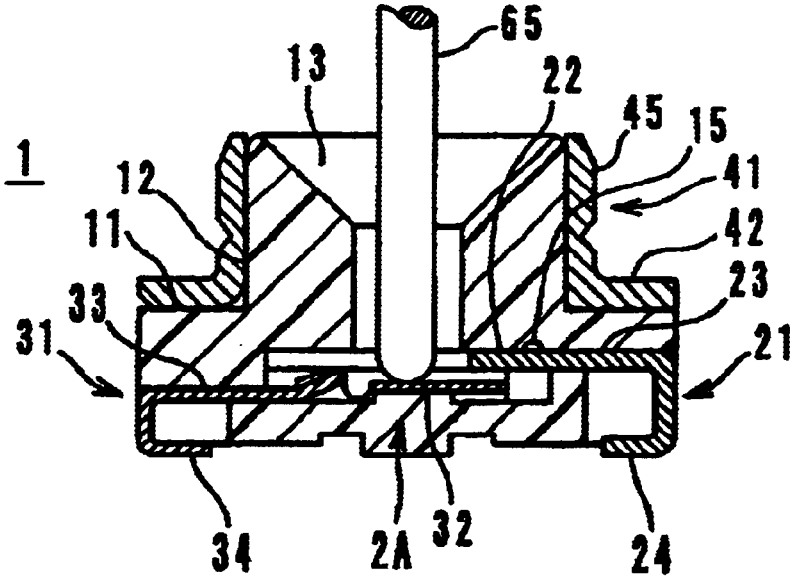
FIG. 15 is a cross sectional view showing a mating coaxial connector fitted onto the coaxial connector of FIG. 12.

On the other hand, as shown in FIG. 15, when the mating coaxial connector is mounted, the center contact 65 of the mating coaxial connector inserted through the introduction hole 13 provided on the upper side pushes the center portion of the movable contact portion 32 downward so that the center portion is inverted and is in the state that the movable contact portion 32 is bent downward into an arc shape. Thereby, the spring contact portion 38 of the movable terminal 31 is released from the contact portion 22 of the fixed terminal 21, so that the electrical connection between the fixed terminal 21 and the movable terminal 31 is interrupted, while the center contact 65 and the movable terminal 31 are electrically connected to each other. Simultaneously, the outer conductor (not shown) of the mating coaxial connector is fitted onto the outer terminal 41, so that the outer conductor and the outer terminal 41 are electrically connected to each other.

When the mating coaxial connector is removed from the coaxial connector 1, the center portion of the movable contact portion 32 is restored to the state that the center portion moves upward, as a result of the spring property. Thereby, the fixed terminal 21 and the movable terminal 31 are electrically connected to each other again, while the electrical connection between the center contact 65 and the movable terminal 31 is interrupted.

Hereinafter, a portable telephone as an example of a communication device according to a second preferred embodiment of the present invention will be described.

Figure 16:
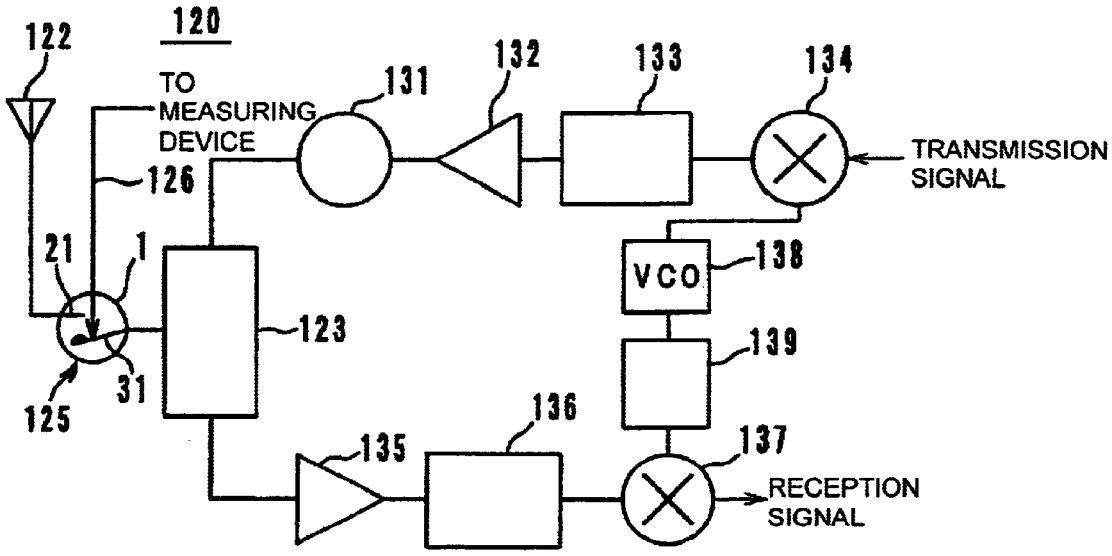
FIG. 16 is a block diagram showing a preferred embodiment of a communication device of the present invention.

FIG. 16 shows an electric circuit block diagram of the RF circuit portion of a portable telephone 120. In FIG. 16, an antenna 122, a diplexer 123, a change-over switch 125, a transmission side isolator 131, a transmission side amplifier 132, a transmission side inter-stage band-pass filter 133, a transmission side mixer 134, a reception side amplifier 135, a reception side inter-stage band-pass filter 136, a reception side mixer 137, a voltage control oscillator (VCO) 138, and a local band-pass filter 139 are shown.

Here, as the change-over switch 125, the coaxial connector 1 of the first preferred embodiment is preferably used. Thereby, e.g., when a telecommunications apparatus manufacture checks the electrical characteristics of the RF circuit portion during the manufacturing process of the portable telephone 120 as an example, a measuring probe (mating coaxial connector) 126 connected to a meter, is fitted onto the coaxial connector 1. Thereby, the signal path from the RF circuit portion to the antenna 122 can be changed to the signal path from the RF circuit portion to the meter. When the measuring probe 126 is removed from the coaxial connector 1, the signal path is returned to the signal path from the RF circuit portion to the antenna 122. Thus, a portable telephone 120 having a high reliability can be realized by mounting the coaxial connector 1.

The present invention including the coaxial connector and the communication device is not limited to the preferred embodiments described above. The coaxial connector and the communication device can be modified within the scope of the sprit of the present invention. The ribs disposed on the insulating case may be provided on the upper insulating case 2B as described in the above-described preferred embodiments, or may be provided on the lower insulating case 2A. Moreover, as the outer profile of the insulating case and the shapes of the concave portions, optional shapes and sizes such as substantially rectangular and substantially circular shapes may be used as desired.

As seen in the above-description, according to preferred embodiments of the present invention, since the fixed terminal and the movable terminal are formed as device elements separate from the insulating cases, respectively, assembly and working of the device elements are achieved with less difficulty as compared with that of conventional device elements that are integrally formed by insert molding. Accordingly, the sum of the unit costs of the respective device elements is smaller than that of the conventional device elements.

Furthermore, a structure in which the first resin member, the second resin member, the fixed terminal, the movable terminal, the external terminal are overlaid on each other, is used. Thus, in production of the coaxial connector, the resin members and other device elements are overlaid and incorporated sequentially while the work pieces are sequentially conveyed. Accordingly, even though the number of device elements is increased, the number of production processes is decreased. Furthermore, since the finishing states of the work-pieces in the respective processes, rejected products can be detected much earlier in the respective processes. Thus, products having high qualities can be provided. In addition, the assembling of the device elements is carried out in one direction, and thereby, the production efficiency is even more improved.

While the present invention has been particularly shown and described with reference to preferred embodiments thereof, it will be understood by those skilled in the art that the foregoing and other changes in form and details can be made without departing from the spirit and scope of the present invention.

What is claimed is:

1. A coaxial connector comprising:

a first resin member having a concave portion into which a center contact of a mating coaxial connector is inserted;

a second resin member arranged to mate with and define an insulating case with the first resin member;

a fixed terminal and a movable terminal fixed directly to the first resin member; and an external terminal mounted on the outside of the insulating case and electrically connected to an outer conductor of the mating coaxial connector; wherein the fixed terminal and the movable terminal are sandwiched between the first resin member and the second resin member; and the coaxial connector is arranged such that the first resin member, the second resin member, the fixed terminal, the movable terminal, and the external terminal are overlaid on each other, such that the assembling arrangement of the first resin member, the second resin member, the fixed terminal, the movable terminal, and the external terminal is in one direction.

2. A coaxial connector according to claim 1, wherein the fixed terminal, the movable terminal and the outer terminal are made of metal.

3. A coaxial connector according to claim 1, wherein the first resin member is smaller than the second resin member.

4. A coaxial connector according to claim 1, wherein the first resin member includes guiding protuberances for positioning the first resin member on the second resin member.

5. A coaxial connector according to claim 1, wherein the fixed terminal includes a contact portion that is in contact with the movable terminal, a fixed portion fixedly sandwiched between the first and second resin members, and a lead that has a substantially L-shaped configuration.

6. A coaxial connector according to claim 5, wherein the fixed portion includes concavities which are fitted onto ribs disposed on the first resin member.

7. A coaxial connector according to claim 1, wherein the movable terminal includes a movable contact portion that contacts with the fixed terminal, a fixed portion fixedly sandwiched between the first and second resin members, and a lead having a substantially L-shaped configuration.

8. A coaxial connector according to claim 7, wherein the fixed portion includes concavities which are fitted onto ribs disposed on the first resin member.

9. A coaxial connector according to claim 1, wherein the first resin member and the second resin member define an upper insulating case and a lower insulating case, respectively, and one of the first resin member and the second resin member includes ribs for mating with rib receiving members disposed in the other of the first resin member and the second resin member.

10. A communication device comprising:

at least one coaxial connector including:

a first resin member having a concave portion into which a center contact of a mating coaxial connector is inserted;

a second resin member arranged to mate with and define an insulating case with the first resin member;

a fixed terminal and a movable terminal fixed directly to the first resin member; and an external terminal mounted on the outside of the insulating case and electrically connected to an outer conductor of the mating coaxial connector; wherein the fixed terminal and the movable terminal are sandwiched between the first resin member and the second resin member; and the coaxial connector is arranged such that the first resin member, the second resin member, the fixed terminal, the movable terminal, and the external terminal are overlaid on each other, such that the assembling arrangement of the first resin member, the second resin member, the fixed terminal, the movable terminal, and the external terminal is in one direction.

11. A communication device according to claim 10, wherein the fixed terminal, the movable terminal and the outer terminal are made of metal.

12. A communication device according to claim 10, wherein the first resin member is smaller than the second resin member.

13. A communication device according to claim 10, wherein the first resin member includes guiding protuberances for positioning the first resin member on the second resin member.

14. A communication device according to claim 10, wherein the fixed terminal includes a contact portion that is in contact with the movable terminal, a fixed portion fixedly sandwiched between the first and second resin members, and lead that has a substantially L-shaped configuration.

15. A communication device according to claim 14, wherein the fixed portion includes concavities which are fitted onto ribs disposed on the first resin member.

16. A communication device according to claim 10, wherein the movable terminal includes a movable contact portion that contacts with the fixed terminal, a fixed portion fixedly sandwiched between the first and second resin members, and a lead having a substantially L-shaped configuration.

17. A communication device according to claim 16, wherein the fixed portion includes concavities which are fitted onto ribs disposed on the first resin member.

18. A communication device according to claim 10, wherein the first resin member and the second resin member define an upper insulating case and a lower insulating case, respectively, and one of the first resin member and the second resin member includes ribs for mating with rib receiving members disposed in the other of the first resin member and the second resin member.

* * * * *